US009150019B2

(12) United States Patent
Takeuchi et al.

(10) Patent No.: US 9,150,019 B2
(45) Date of Patent: Oct. 6, 2015

(54) LIQUID EJECTION HEAD BODY AND METHOD OF MANUFACTURING THE SAME

(75) Inventors: Souta Takeuchi, Fujisawa (JP); Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/130,977

(22) PCT Filed: Aug. 30, 2012

(86) PCT No.: PCT/JP2012/072660

§ 371 (c)(1),
(2), (4) Date: Jan. 6, 2014

(87) PCT Pub. No.: WO2013/035760

PCT Pub. Date: Mar. 14, 2013

(65) Prior Publication Data

US 2014/0132674 A1 May 15, 2014

(30) Foreign Application Priority Data

Sep. 9, 2011 (JP) ..... 2011-197143

(51) Int. Cl.
*B41J 2/015* (2006.01)
*B41J 2/14* (2006.01)
*B41J 2/16* (2006.01)

(52) U.S. Cl.
CPC ..... *B41J 2/1433* (2013.01); *B41J 2/14072* (2013.01); *B41J 2/1603* (2013.01); *B41J 2/1626* (2013.01); *B41J 2/1628* (2013.01); *B41J 2/1629* (2013.01); *B41J 2/1631* (2013.01); *B41J 2/1634* (2013.01); *B41J 2/1642* (2013.01); *B41J 2/1645* (2013.01); *B41J 2002/14387* (2013.01)

(58) Field of Classification Search
None
See application file for complete search history.

(56) References Cited

U.S. PATENT DOCUMENTS

| | | | |
|---|---|---|---|
| 6,123,410 | A | 9/2000 | Beerling et al. |
| 6,322,206 | B1 | 11/2001 | Boyd et al. |
| 6,325,488 | B1 | 12/2001 | Beerling et al. |
| 6,435,653 | B1 | 8/2002 | Boyd et al. |

(Continued)

FOREIGN PATENT DOCUMENTS

| | | | |
|---|---|---|---|
| JP | 64-64858 | A | 3/1989 |
| JP | 11-192705 | A | 7/1999 |

(Continued)

OTHER PUBLICATIONS

International Search Report and Written Opinion of the International Searching Authority mailed Oct. 30, 2012 in International Application No. PCT/JP2012/072660.

(Continued)

*Primary Examiner* — Erica Lin
(74) *Attorney, Agent, or Firm* — Fitzpatrick, Cella, Harper & Scinto

(57) ABSTRACT

A liquid ejection head body includes a substrate and a channel forming member arranged on the substrate. The channel forming member has a liquid ejection port for ejecting liquid and a liquid channel communicating with the liquid ejection port, while the substrate has an ejection energy generating element for generating energy for ejecting liquid at a first surface side and a liquid supply port for supplying liquid to the liquid channel in the inside. A conductive layer for electrically connecting the first surface side and a second surface side disposed opposite to the first surface side is arranged along the lateral surface of the liquid supply port.

20 Claims, 18 Drawing Sheets

(56) References Cited

U.S. PATENT DOCUMENTS

| | | | |
|---|---|---|---|
| 6,508,536 | B1 | 1/2003 | Beerling et al. |
| 6,513,907 | B2 | 2/2003 | Beerling et al. |
| 6,592,205 | B2 | 7/2003 | Beerling et al. |
| 6,679,596 | B2 | 1/2004 | Boyd et al. |
| 6,981,760 | B2 | 1/2006 | Yamamoto |
| 7,226,156 | B2 | 6/2007 | Boyd et al. |
| 7,686,428 | B2 | 3/2010 | Komuro |
| 7,896,475 | B2 | 3/2011 | Omata et al. |
| 7,980,676 | B2 | 7/2011 | Hirosawa et al. |
| 7,985,531 | B2 | 7/2011 | Kanri et al. |
| 8,240,815 | B2 | 8/2012 | Uyama et al. |
| 8,241,510 | B2 | 8/2012 | Sakurai |
| 8,322,829 | B2 | 12/2012 | Sakuma et al. |
| 8,691,101 | B2 | 4/2014 | Takeuchi et al. |
| 2003/0058308 | A1 | 3/2003 | Yamamoto |
| 2007/0247494 | A1 | 10/2007 | Komuro |
| 2008/0173616 | A1 | 7/2008 | Sakurai |
| 2008/0227035 | A1 | 9/2008 | Kanri et al. |
| 2009/0179965 | A1 | 7/2009 | Hirosawa et al. |
| 2009/0212008 | A1* | 8/2009 | Uyama et al. ..... 216/27 |
| 2011/0012960 | A1 | 1/2011 | Sakuma et al. |
| 2011/0018934 | A1 | 1/2011 | Uyama et al. |
| 2011/0059558 | A1* | 3/2011 | Takeuchi et al. ..... 438/21 |

FOREIGN PATENT DOCUMENTS

| | | | |
|---|---|---|---|
| JP | 2003-170597 | A | 6/2003 |
| JP | 2007-290160 | A | 11/2007 |
| JP | 2008-149472 | A | 7/2008 |
| JP | 2008-201129 | A | 9/2008 |
| JP | 2008-221757 | A | 9/2008 |
| JP | 2009-6552 | A | 1/2009 |
| JP | 2011-25547 | A | 2/2011 |
| JP | 2011-37262 | A | 2/2011 |

OTHER PUBLICATIONS

Preliminary Report on Patentability issued in PCT/JP2012/072660 dated Mar. 12, 2014.

* cited by examiner

LIQUID EJECTION HEAD BODY AND METHOD OF MANUFACTURING THE SAME

TECHNICAL FIELD

This invention relates to a body (or a main part) of a liquid ejection head for ejecting liquid and a method of manufacturing the same.

BACKGROUND ART

Three-dimensional packaging technologies have been proposed in recent years in order to meet the demand for downsized electronic devices and devices having a raised mounting density. With the proposed three-dimensional packaging technologies, an electrode is formed so as to run through a substrate on which a semiconductor device is formed (i.e. a so-called through-electrode). With such technologies, the mounting density of devices is raised to downsize the final product not by arranging a plurality of semiconductor devices on a planar mounting surface but by vertically laying devices one on the other by way of a through-electrode.

In the case of forming an inkjet head body, on the other hand, as a result of formation of a through-electrode, an ink ejecting element of the head can be electrically connected thereto from the rear surface side of a substrate that is the side opposite to the direction of ink ejection. This technique provides advantages including an advantage of providing a capability of manufacturing a long recording head where a plurality of recording substrates are arranged side by side.

Known patent literature that proposes three-dimensional packaging technologies for inkjet head body includes PTL 1 listed below.

CITATION LIST

Patent Literature

PTL 1: Japanese Patent Application Laid-Open No. 11-192705

SUMMARY OF INVENTION

Technical Problem

As described above, the mounting density of a liquid ejection head body can be raised and the final product can be downsized by means of a three-dimensional packaging technology. However, liquid ejection head bodies are facing needs of realizing a higher mounting density and further downsizing.

Therefore, the object of the present invention is to provide a liquid ejection head body adapted for realizing a higher mounting density and further downsizing.

Solution to Problem

According to the present invention, the above object is achieved by providing a liquid ejection head body including a substrate and a channel forming member arranged on the substrate, the channel forming member having a liquid ejection port for ejecting liquid and a liquid channel communicating with the liquid ejection port, the substrate having an ejection energy generating element for generating energy for ejecting liquid on a first surface side thereof where the channel forming member is arranged and a liquid supply port running through the substrate from a second surface side opposite to the first surface side to the first surface side to supply liquid to the liquid channel, wherein a conductive layer for electrically connecting the first surface side and the second surface side is arranged along the lateral surface of the liquid supply port.

Thus, according to the present invention, there is provided a liquid ejection head body adapted to realizing a higher mounting density and further downsizing for the final product.

Further features of the present invention will become apparent from the following description of exemplary embodiments with reference to the attached drawings.

DESCRIPTION OF EMBODIMENTS

The present invention relates to a liquid ejection head body. A liquid ejection head body according to the present invention includes a channel forming member and a substrate. The channel forming member has a liquid ejection port for ejecting liquid and a liquid channel communicating with the liquid ejection port. The substrate has an ejection energy generating element for generating energy for ejecting liquid on a first surface side thereof where the channel forming member is arranged and a liquid supply port running through the substrate from the opposite side (a second surface side) to the first surface side to supply liquid to the liquid channel. According to the present invention, a conductive layer for electrically connecting the first surface side and the second surface side is arranged along the lateral surface of the liquid supply port.

According to the prior art, a through-electrode is formed to electrically connect the front surface side and the rear surface side of a substrate and a through-hole running through the substrate needs to be formed in addition to a through-hole that operates as ink supply port.

According to the present invention, on the other hand, a conductive layer is formed along the lateral surface of a liquid supply port and hence an additional through-hole for a through-electrode does not need to be formed. As a result, the degree of freedom of wiring is improved.

Particularly, since the ejection energy generating element and the liquid supply port are formed in areas located close to each other, the conductive layer of the liquid supply port can be utilized as wiring for the ejection energy generating element to consequently improve the degree of freedom of the layout of the substrate so as to allow further downsizing.

In this specification, the present invention is mainly described in terms of inkjet head body, which is an exemplar application of the present invention. However, the present invention is by no means limited thereto and equally applicable to liquid ejection head bodies to be used e.g. for preparation of biochips and electronic circuit printing. Incidentally, the present invention is also applicable to liquid ejection head bodies for manufacturing color filters.

Embodiment 1

Figure 1:
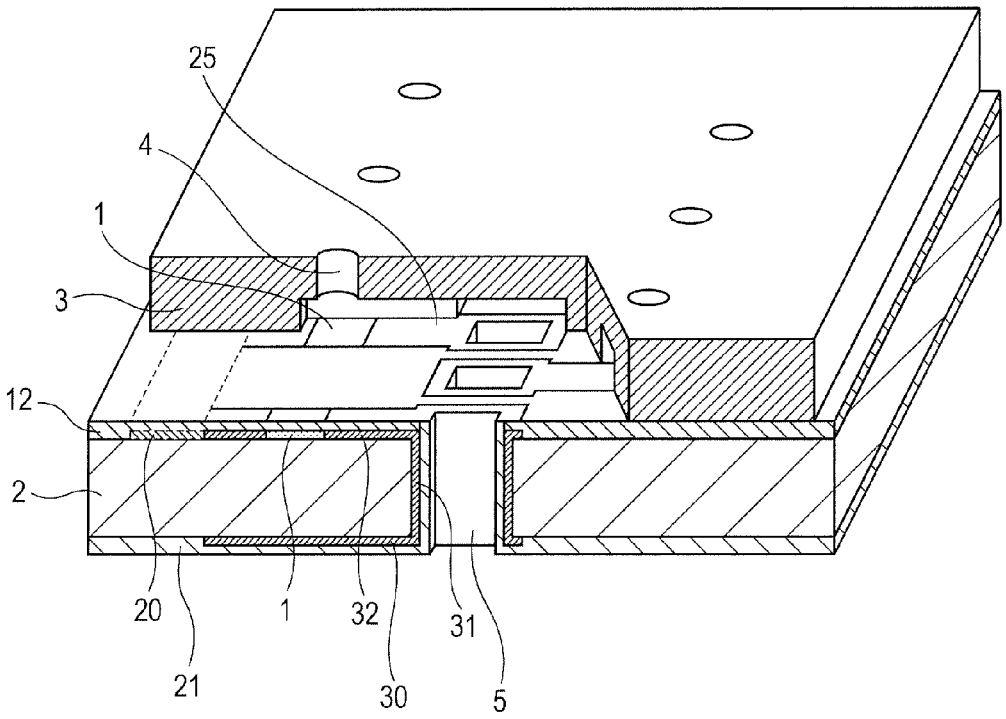
FIG. 1 is a schematic perspective view of an embodiment of inkjet head body according to the present invention, illustrating an exemplar configuration thereof (individual supply port type).
Figure 2:
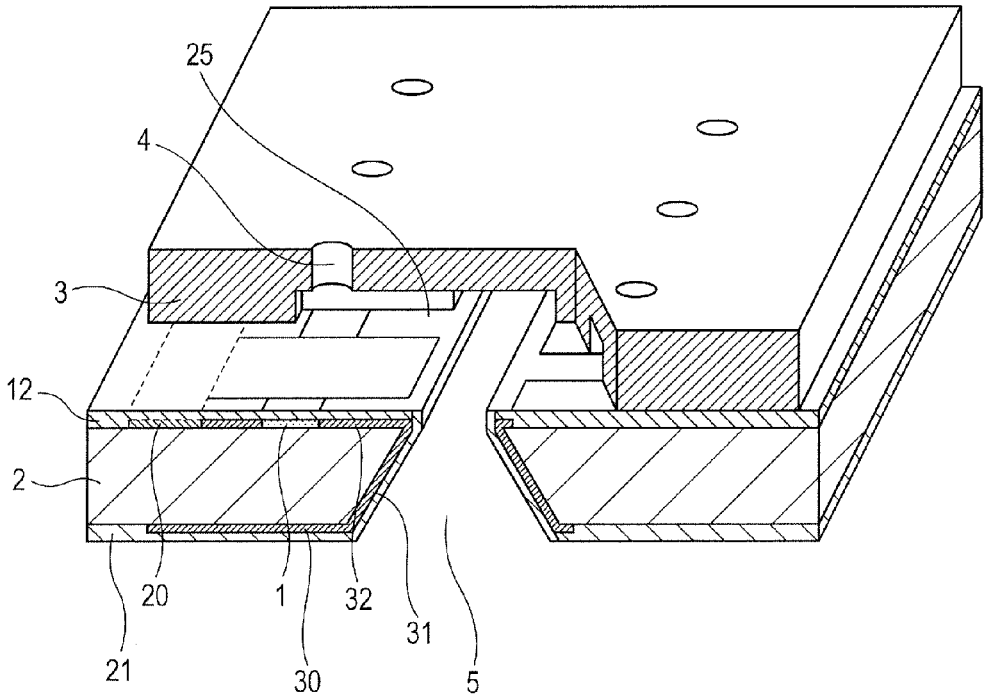
FIG. 2 is a schematic perspective view of an embodiment of inkjet head body according to the present invention, illustrating an exemplar configuration thereof (common supply port type).
Figure 3:
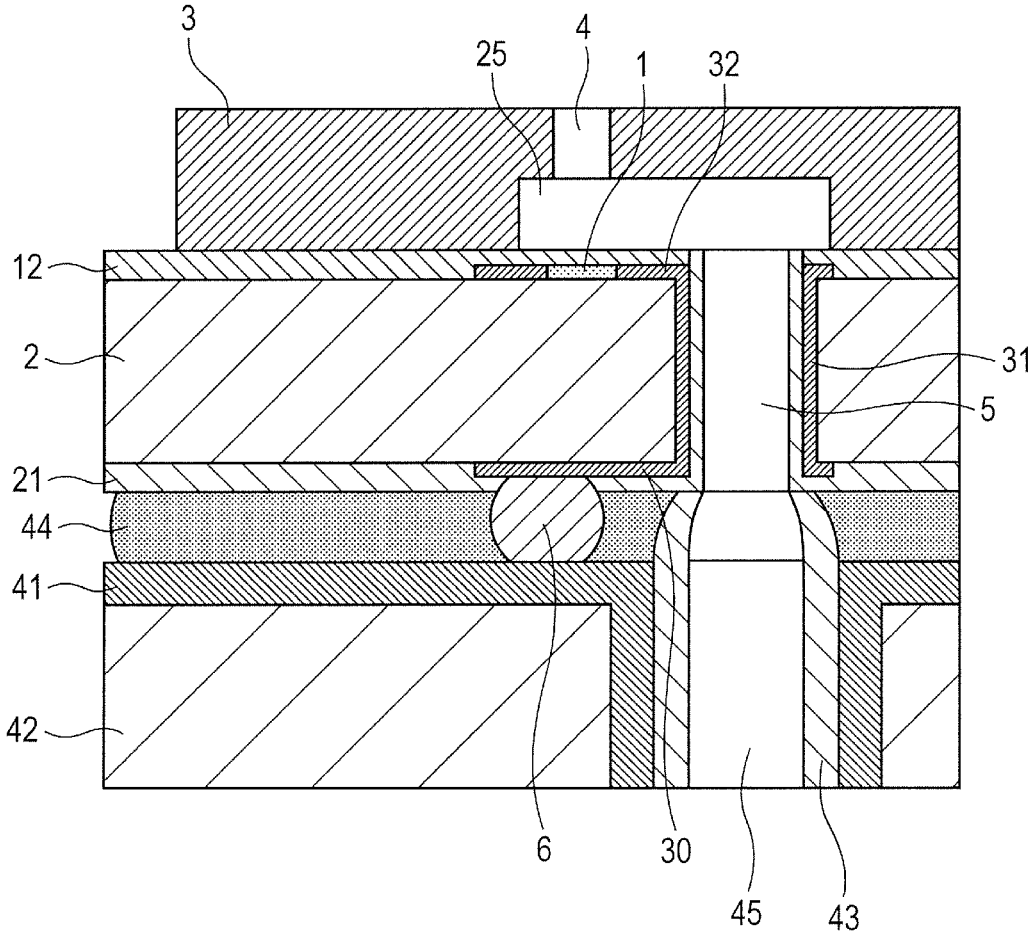
FIG. 3 is a schematic cross-sectional view of an embodiment of inkjet head body according to the present invention held to a mounted position (individual supply port type).
Figure 4:
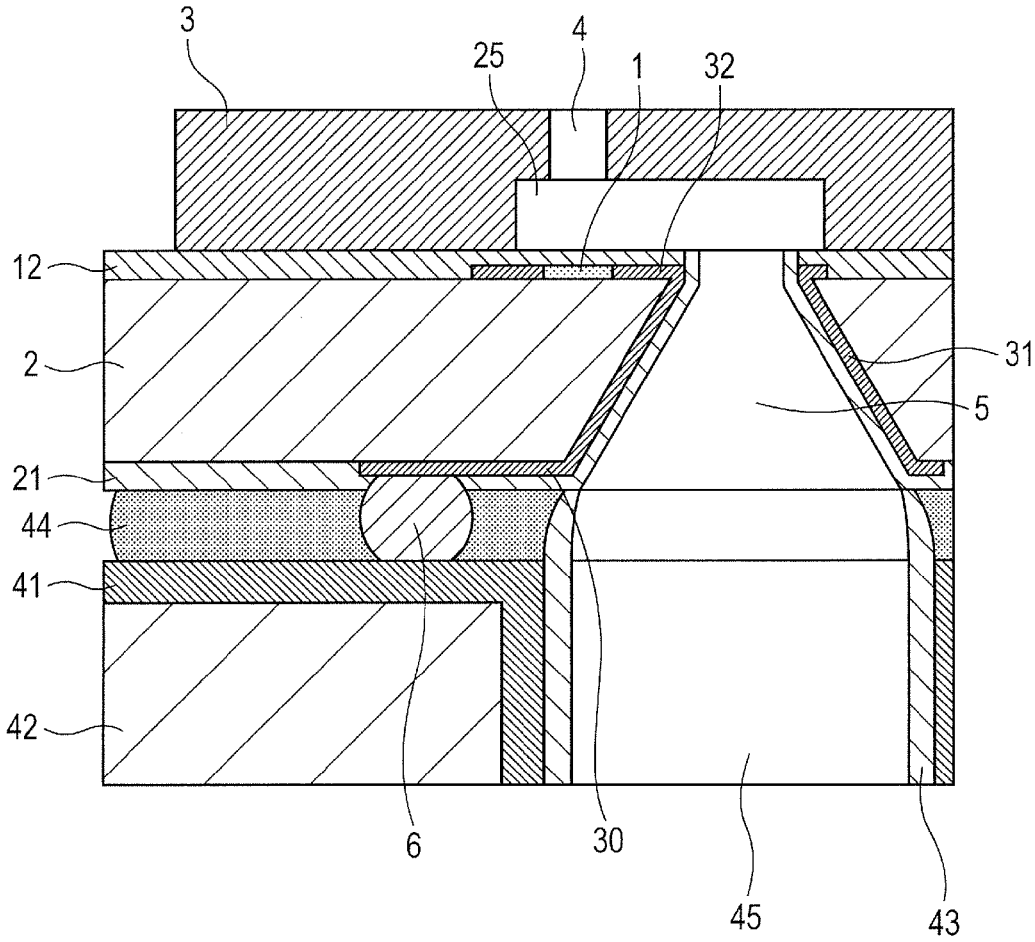
FIG. 4 is a schematic cross-sectional view of an embodiment of inkjet head body according to the present invention held to a mounted position (common supply port type).

FIGS. 1 and 2 are schematic perspective views of embodiments of inkjet head body according to the present invention. FIGS. 3 and 4 are schematic cross-sectional views of embodiments of inkjet head body according to the present invention held to respective mounted positions. Note that the cross-sectional views of FIGS. 3 and 4 exactly correspond to the respective cross section parts of FIGS. 1 and 2. FIGS. 1 and 3 illustrate an embodiment having an individual liquid supply port type arrangement (individual ink supply port type arrangement) as liquid supply port arrangement, whereas FIGS. 2 and 4 illustrate an embodiment having a common liquid supply port type arrangement (common ink supply port type arrangement) as liquid supply port arrangement. Note that both individual ink supply ports and common ink supply ports are denoted by the same reference symbols because they provide exactly the same effects regardless of the difference in the form of ink supply port.

Now, an embodiment of the present invention will be described below by referring to FIGS. 1 and 3.

FIG. 1 illustrates an inkjet head body including a substrate 2 and a channel forming member 3 formed on the substrate 2 with an ink ejection port 4 facing upward. In FIG. 1, the channel forming member 3 is provided to produce an ink ejection port 4 and an ink channel 25 communicating with the ink ejection port 4. An ejection energy generating element 1 such as a heater is formed on the substrate 2. The substrate 2 is typically a silicon substrate through which an ink supply port 5 communicating with the front surface (first surface) side and the rear surface (second surface) side of the substrate 2 is formed. Ink is ejected from the ink ejection port 4 by the energy generated from the ejection energy generating element 1 and, at the same time, ink is supplied from the ink supply port 5 to the ink channel 25. The ejected ink hits a recording medium for a printing operation.

A conductive layer 31 is formed on the lateral wall of the ink supply port 5 that is formed as a through-hole in the substrate 2 so as to electrically connect the front surface side and the rear surface side of the substrate. More specifically, the conductive layer 31 is connected to a front surface wiring layer 32 arranged at the front surface side of the substrate 2 and also to a rear surface wiring layer 30 arranged at the rear surface side of the substrate 2. While the conductive layer 31 is formed on the entire surface of the lateral wall of the through-hole formed in the substrate 2 in FIG. 1, the conductive layer 31 may be formed in some other way provided that the conductive layer 31 electrically connects the front surface side and the rear surface side of the substrate. For example, the conductive layer 31 may be divided into a plurality of regions, each of which functions as wiring.

In FIG. 1, the conductive layer 31 is arranged on the inner wall of the through-hole of the substrate and functions as through-electrode wiring. The conductive layer 31 is covered by a protective film 21 in order to prevent the conductive layer 31 from contacting ink.

Any material can be used for the conductive layer 31 so long as the material is electrically conductive. For example, a material that can be used for electric wiring may be used as the material of the conductive layer 31.

Any material can be used for the protective film 21 so long as the material is resistant against liquid including ink and electrically insulating. Examples of materials that can be used for the protective film 21 include organic materials such as polyparaxylylene, polyparaxylene derivatives including polymonochloroparaxylylene, polydichloroparaxylylene and polytetrafluoroparaxylylene, polyurea resin and polyimide resin and inorganic materials such as silicon oxide and silicon nitride.

As illustrated in FIG. 1, the protective film 21 may also be arranged on the rear surface (second surface) of the substrate 2. If such is the case, the protective film 21 is preferably so arranged as to cover the rear surface wiring layer 30 that is arranged on the rear surface of the substrate 2 as illustrated in FIG. 1.

As illustrated in FIG. 1, a substrate protective film 12 may be arranged at the front surface side of the substrate 2 in order to protect the ejection energy generating element 1, the front surface wiring layer 32, the drive circuit 20 and so on.

A pair of electrodes is connected to the ejection energy generating element 1, which may be a heater. One of the electrodes operates as power wiring while the other electrode operates as grounding wiring. Electric power to be supplied to the ejection energy generating element 1 is firstly supplied from the power wiring by way of the pair of electrodes arranged at the opposite sides of the element. In the case of the embodiment illustrated in FIG. 3, electric power is supplied from a ceramic substrate conductive layer 41 arranged on a ceramic substrate 42 and led to the inside of inkjet body by way of a bump 6 connected to the conductive layer 41. Then, in the inkjet body, power is supplied from the rear surface wiring layer 30, which is connected to the bump 6, to the conductive layer 31. Then, power is supplied from the conductive layer 31 that functions as through-electrode wiring to the front surface wiring layer 32 and further from the front surface wiring layer 32 to the ejection energy generating element 1. Note that the front surface wiring layer 32 may form part of the ejection energy generating element.

FIG. 3 illustrates a mode of realizing the present invention in which an inkjet head body as illustrated in FIG. 1 is mounted on a mounting base. Referring to FIG. 3, the mounting base is formed mainly by the ceramic substrate 42. An ink introducing port 45 is arranged in the ceramic substrate 42 and the inkjet head body is mounted in such a way that the ink introducing port 45 communicates with the ink supply port 5. On the lateral surface of the ink introducing port 45, a ceramic substrate protective film 43 is provided. A ceramic substrate conductive layer 41 is arranged under the ceramic substrate protective film 43. The ceramic substrate conductive layer 41 is also arranged at the front surface side of the ceramic substrate 42. The ceramic substrate conductive layer 41 and the rear surface wiring layer 30 are electrically connected to each other by way of the bump 6. A sealing member 44 is arranged between the mounting base and the inkjet head body to establish a tight sealing effect.

As a conductive layer is arranged on the lateral surface of the liquid supply port according to the present invention, there is no need of arranging an additional through-hole that runs through the substrate beside the liquid supply port. Then, as a result, the liquid ejection head body can be downsized.

Furthermore, since the liquid supply port is arranged close to the ejection energy generating element, the parasitic resistance of wiring that arises when driving the ejection energy generating element can be reduced to improve the energy efficiency by utilizing the conductive layer arranged on the lateral surface of the liquid supply port.

Besides, a large perimeter or area and a large wiring width can be provided for the conductive layer by arranging the conductive layer on the entire surface of the lateral wall of the liquid supply port so as to entirely surround the latter. Then, the parasitic resistance of wiring can be further reduced to additionally improve the energy efficiency.

Embodiment 2

FIGS. 12A through 12I are schematic cross-sectional views of an embodiment of inkjet head body according to the present invention, illustrating the method of manufacturing the embodiment. This embodiment will now be described below by referring to FIGS. 12A through 12I.

Figure 12A:
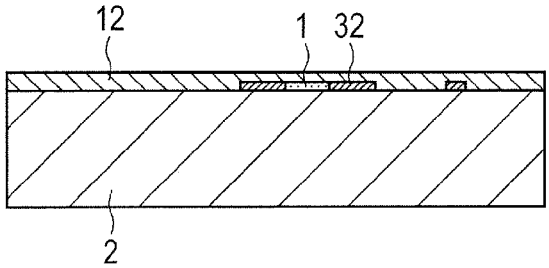
FIGS. 12A, 12B, 12C, 12D, 12E, 12F, 12G, 12H, and 12I are schematic cross-sectional views of an embodiment of inkjet head body according to the present invention, illustrating the method of manufacturing the embodiment (individual supply port type).

Firstly, as illustrated in FIG. 12A, a silicon substrate 2 on which a semiconductor element (not illustrated) or ejection energy generating element 1 is formed is brought in.

Such a semiconductor element or an ejection energy generating element 1 can be formed by means of a multilayer wiring technique typically using photolithography.

The ejection energy generating element 1 is formed at the front surface side (first surface side) of the silicon substrate 2. A front surface wiring layer 32 that is connected to the ejection energy generating element 1 is formed on the front surface side of the silicon substrate 2. A substrate protective film 12 is formed on the ejection energy generating element 1 and the front surface wiring layer 32.

Figure 12B:
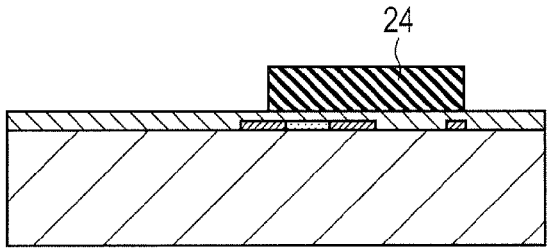

Then, as illustrated in FIG. 12B, an ink channel pattern 24 is formed as mold member for an ink channel.

The ink channel pattern 24 operates as a mold member for forming an ink channel 25 and is removed in a later step. Therefore, the material of the ink channel pattern is preferably selected on an assumption that a process of removing the ink channel pattern will be executed later. For example, positive type resist can be employed as the material of the ink channel pattern 24.

Figure 12C:
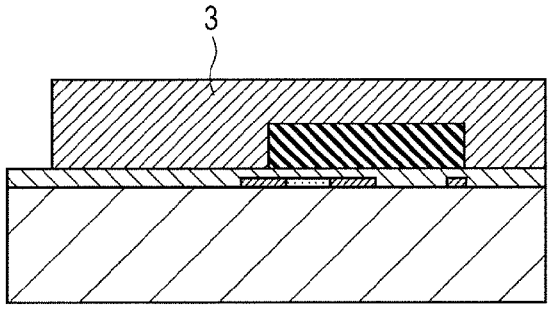

Then, as illustrated in FIG. 12C, a channel forming member 3 is formed on the ink channel pattern 24.

For example, negative type resist can be employed as the material of the channel forming member 3.

Figure 12D:
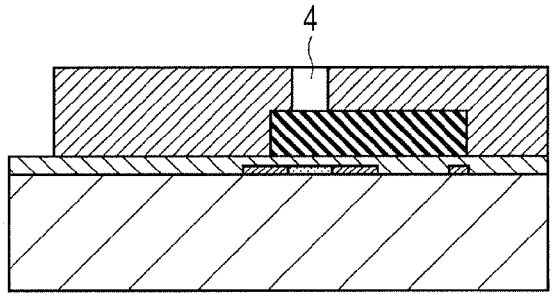

Then, as illustrated in FIG. 12D, an ink ejection port 4 is formed in the channel forming member 3 by photolithography.

Figure 12E:
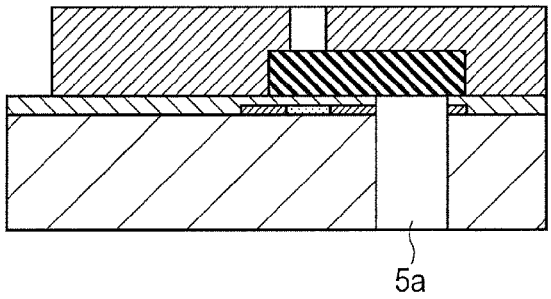

Subsequently, as illustrated in FIG. 12E, the silicon substrate 2 is etched from the rear surface side (second surface side) all the way to the front surface side to form through-hole 5*a*.

A Deep-RIE technique or an anisotropic etching technique can be used for the above etching operation. Anisotropic etching may be reactive ion etching (RIE) or anisotropic crystal etching. Deep-RIE is preferably employed as RIE. A Bosch process can be employed for Deep-RIE.

Figure 12F:
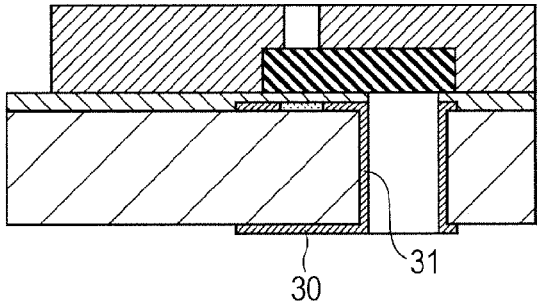

Then, as illustrated FIG. 12F, a conductive layer 31 is formed on the lateral wall of the through-hole. At this time, rear surface wiring layer 30 can also be formed by arranging a conductive material on the rear surface of the silicon substrate 2.

The conductive layer 31 is desirably formed from the rear surface side of the silicon substrate 2. The conductive layer 31 is formed so as to be electrically connected to the front surface wiring layer 32 that is arranged at the front surface side of the silicon substrate 2. The front surface wiring layer 32 may be multilayer wiring.

The conductive layer 31 can be formed, for example, by means of plating, CVD, sputtering, or evaporation.

Figure 12G:
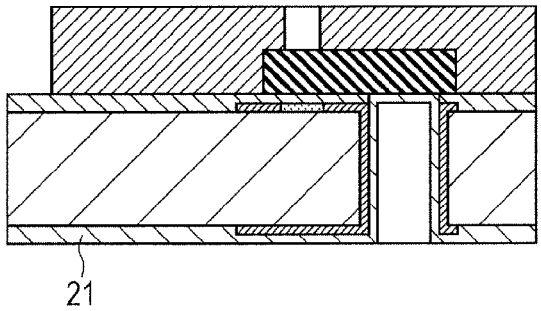

Then, as illustrated in FIG. 12G, a protective film 21 that provides an excellent coverage effect is formed on the conductive layer 31 in order to secure a sufficient degree of resistance against ink for the ink supply port. At this time, the protective film 21 can be formed at the rear surface side of the silicon substrate 2 at the same time to cover the rear surface wiring layer 30.

Figure 12H:
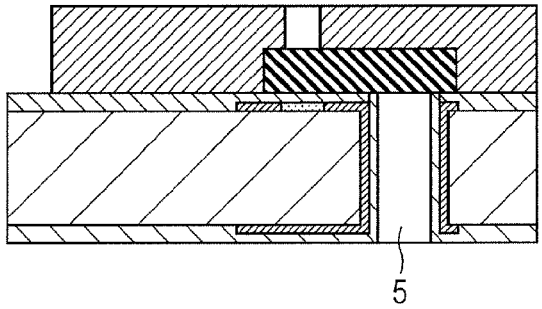

Then, as illustrated in FIG. 12H, the protective film 21 on the bottom surface part of the through-hole is removed to produce ink supply port 5. Note that the lateral wall of the ink supply port is covered by the protective film 21.

Techniques that can be used to remove the protective film 21 include laser techniques and RIE.

At this time, the part of the protective film 21 at the rear surface side of the silicon substrate 2 that corresponds to external input/output electrodes can be partly removed at the same time.

Figure 12I:
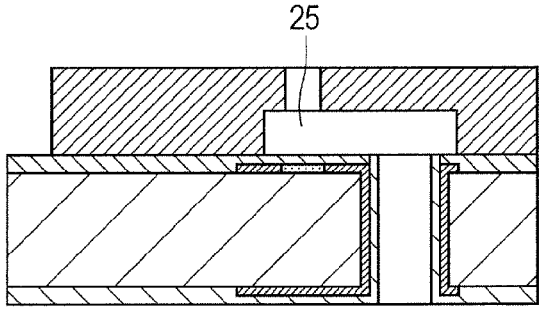

Then, as illustrated in FIG. 12I, the ink channel pattern 24 is dissolved and removed to produce the ink channel 25.

The process of manufacturing an inkjet head body is completed when the above steps are over.

In this embodiment, an insulating film can be arranged between the silicon substrate 2 and the conductive layer 31 or between the silicon substrate 2 and the rear surface wiring layer 30. Additionally, an insulating film can be arranged between the silicon substrate 2 and the front surface wiring layer 32 or between the silicon substrate 2 and the substrate protective film 12. These insulating films can be formed by using the same material as that of the protective film 21.

While the manufacturing method of this embodiment is based on a method that is generally referred to as "casting method", the present invention is by no means limited thereto.

Now, the mounting base will be described below by referring to FIG. 3.

The obtained inkjet head body is cut out from the wafer by dicing and then bonded to and mounted on a mounting base that operates as head substrate by means of the bump 6.

The mounting base is mainly formed by a ceramic substrate 42 and an ink introducing port 45 is formed in the ceramic substrate 42. A ceramic substrate conductive layer 41 is formed on the lateral surface of the ink introducing port 45 of the ceramic substrate 42 and covered by a ceramic substrate protective film 43.

The ceramic substrate conductive layer 41 is so formed as to extend to the surface of the ceramic substrate 42 and electrically connected to the rear surface wiring layer 30 of the inkjet head body by means of the bump 6. The connecting section is sealed by sealing member 44 that is made of a resin material.

The ceramic substrate protective film 43 can be formed from the rear surface side of the ceramic substrate 42 after mounting the inkjet head body.

Embodiment 3

Different wiring arrangements arise for ejection energy generating elements depending on if there is a drive circuit arranged on the substrate front surface or not. For the purpose of the present invention, a drive circuit refers to an integrated circuit for switching operations for driving an ejection energy generating element. Such a drive circuit can be formed in a substrate by means of a semiconductor element.

When a drive circuit is formed in a substrate, an arrangement of connecting the wiring of one of a pair of electrodes for driving the ejection energy generating element to the drive circuit and connecting the wiring of the other electrode to the conductive layer may be employed.

If, for example, no drive circuit is arranged on the front surface side of the substrate, both the power wiring and the grounding wiring can be taken out to the rear surface side of the substrate by way of the conductive layer 31 arranged on the lateral surface of the ink supply port 5 that functions as through-electrode wiring.

Figure 5:
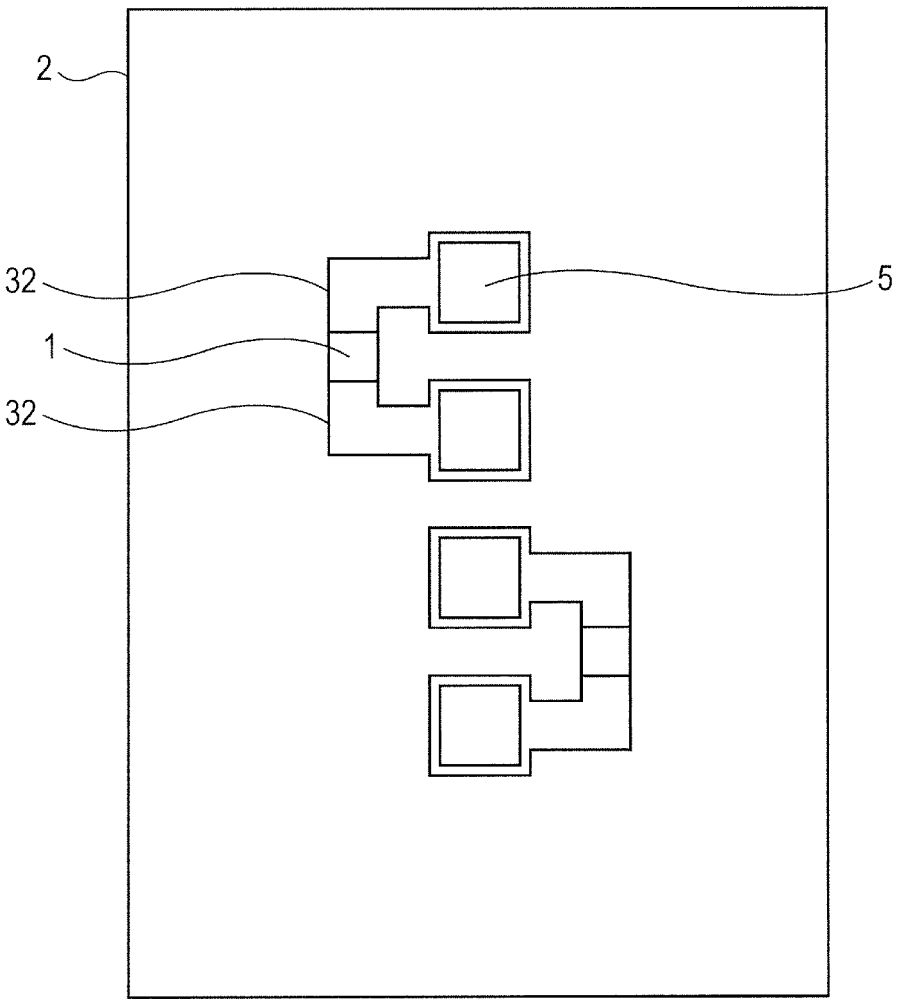
FIG. 5 is a schematic top plan view of a substrate, illustrating an exemplar wiring arrangement of an embodiment of inkjet head body according to the present invention (individual supply port type).

FIG. 5 is a schematic top plan view of a substrate, illustrating an exemplar arrangement of an embodiment of inkjet head body according to the present invention. This embodiment will be described below in detail. In FIG. 5, individual ink supply ports 5 are provided and an ejection energy generating element 1 (e.g., heater element) is connected to front surface wiring layer 32. The front surface wiring layer 32 includes a pair of electrodes of the ejection energy generating element and one of the electrodes operates as power wiring while the other electrode operates as grounding wiring. In the mode of realizing the present invention illustrated in FIG. 5, both the power wiring and the grounding wiring of the ejection energy generating element are electrically connected to the rear surface side of the substrate by way of the conductive layer 31 arranged on the lateral surface of the ink supply port 5. In other words, power is supplied to the power wiring from the rear surface side of the substrate by way of the conductive layer 31 and the grounding wiring is grounded at the rear surface side of the substrate by way of the conductive layer 31.

The embodiment illustrated in FIG. 5 is effective when an individual ink supply port type arrangement is provided.

In the case of an embodiment having an individual ink supply port type arrangement, for example, a plurality of individual ink supply ports can be arranged in a row along a plurality of ejection energy generating elements. One or more individual ink supply ports may be held in communication with a single ejection energy generating element. Alternatively, one or more individual ink supply ports may be held in communication with a plurality of ejection energy generating elements. For example, two rows of ink ejection ports may be provided at the respective opposite sides of a row of individual ink supply ports.

Embodiment 4

When a drive circuit is arranged at the front surface side of a substrate, either one 32 of the power wiring and the grounding wiring can be taken out from the rear surface side of the substrate by way of the conductive layer 31 arranged on the lateral surface of the ink supply port 5 that functions as through-electrode wiring.

Figure 6:
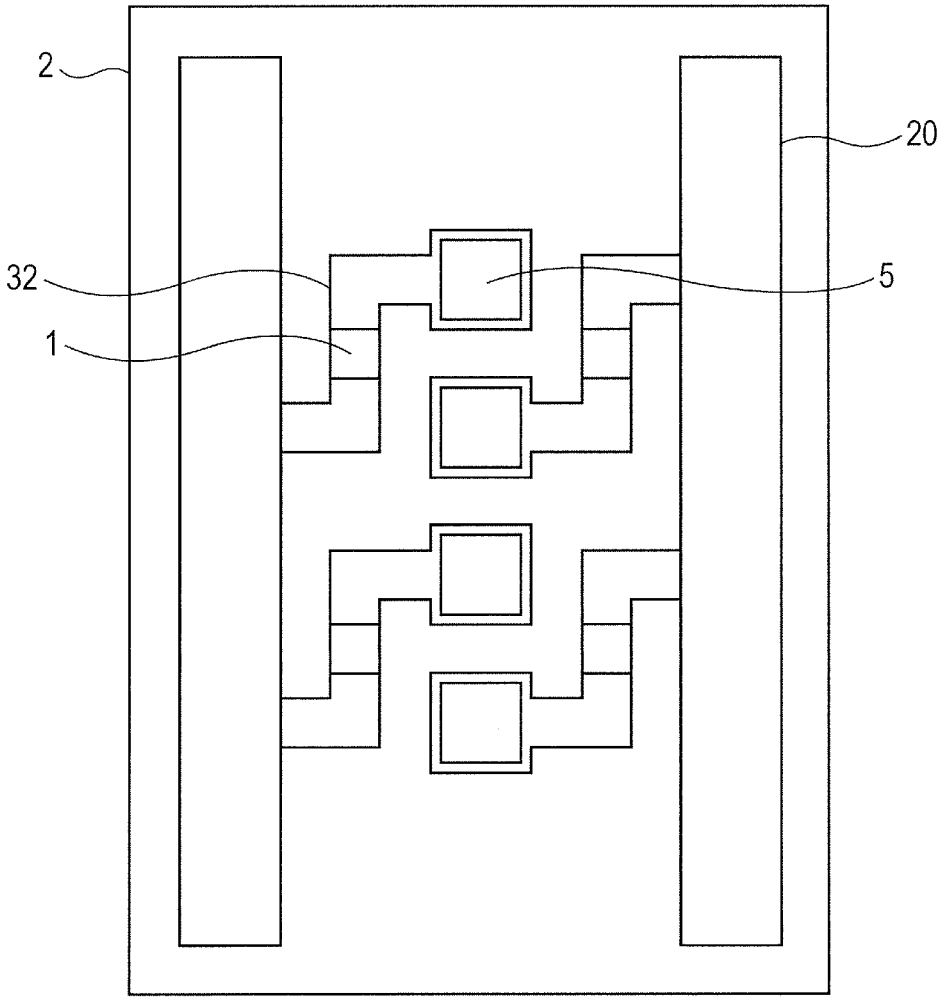
FIG. 6 is a schematic top plan view of a substrate, illustrating an exemplar wiring arrangement of an embodiment of inkjet head body according to the present invention (individual supply port type).

FIG. 6 is a schematic top plan view of a substrate, illustrating an exemplar arrangement of an embodiment of inkjet head body according to the present invention. This embodiment will be described below in detail. In this embodiment, a drive circuit 20 is formed on the front surface side of a substrate. The drive circuit 20 may typically be formed by a transistor that operates as switch and a signal line for driving the transistor. The embodiment illustrated in FIG. 6 has an individual ink supply port type arrangement as ink supply port arrangement and either the power wiring or the grounding wiring of each ejection energy generating element is electrically connected to the rear surface side of the substrate by way of the conductive layer 31, while the other wiring is electrically connected to the drive circuit 20.

Since through-electrode wiring is arranged on the lateral surface of each ink supply port of this embodiment, this embodiment provides a higher degree of freedom of layout for the drive circuit 20. Accordingly, the substrate of the embodiment can be downsized.

Figure 7:
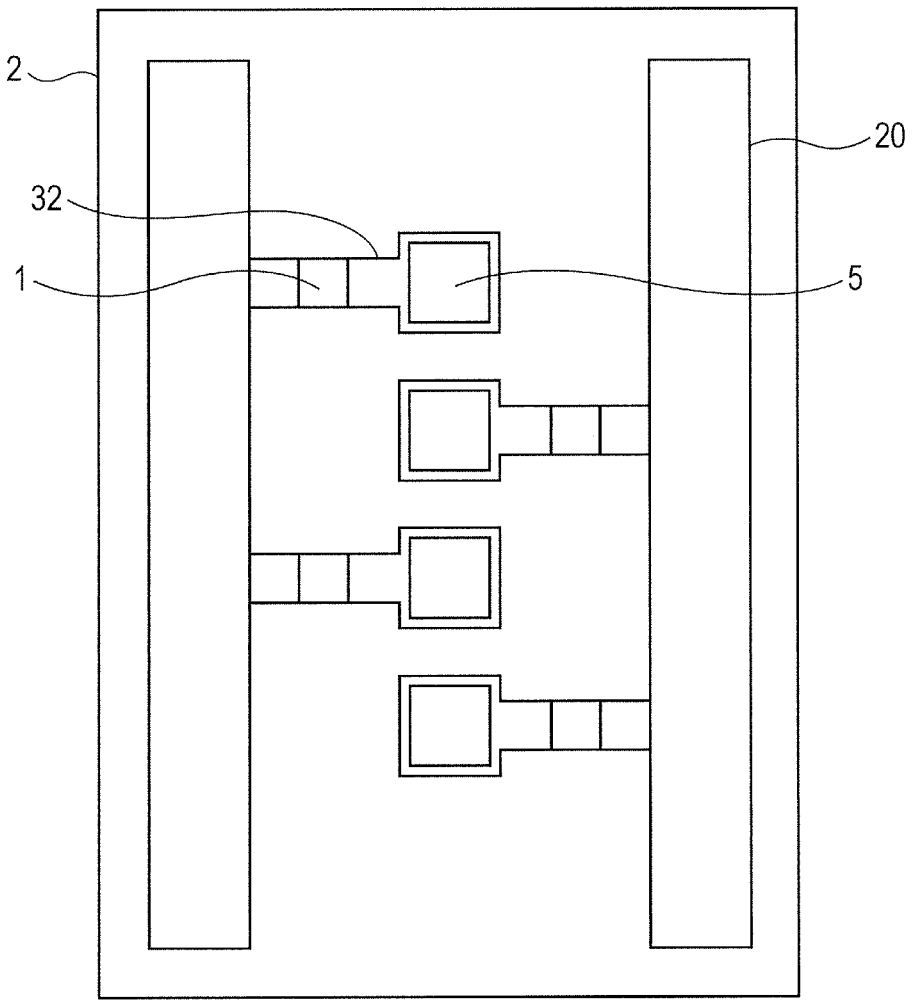
FIG. 7 is a schematic top plan view of the substrate, illustrating an alternative exemplar wiring arrangement of the embodiment of inkjet head body of FIG. 6 (individual supply port type).

FIG. 7 illustrates an alternative exemplar wiring arrangement of this embodiment. The arrangement of FIG. 7 differs from that of FIG. 6 in the direction of leading out the electrodes of each of the ejection energy generating elements. With the arrangement of FIG. 7, both the power wiring and the grounding wiring of each of the ejection energy generating elements are arranged linearly. This arrangement provides an advantage of reducing the parasitic resistance of wiring.

Embodiment 5

Figure 8:
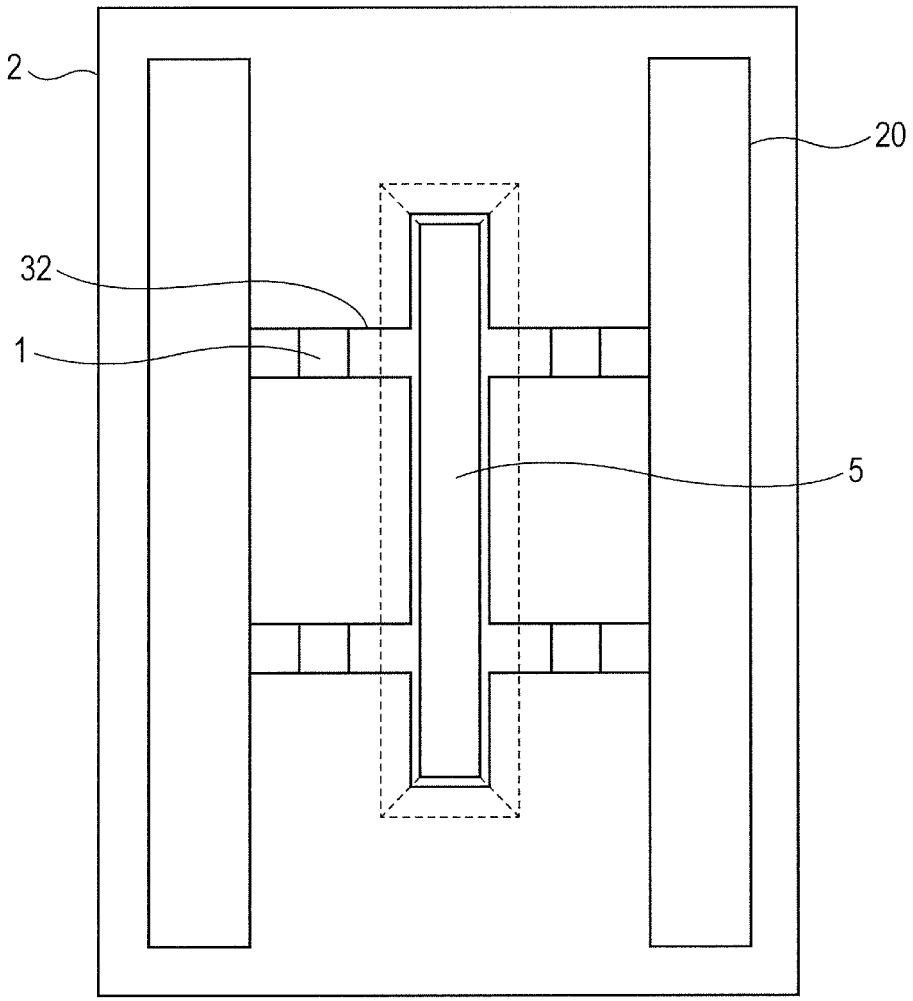
FIG. 8 is a schematic top plan view of a substrate, illustrating an exemplar wiring arrangement of an embodiment of inkjet head body according to the present invention (common supply port type).
Figure 9:
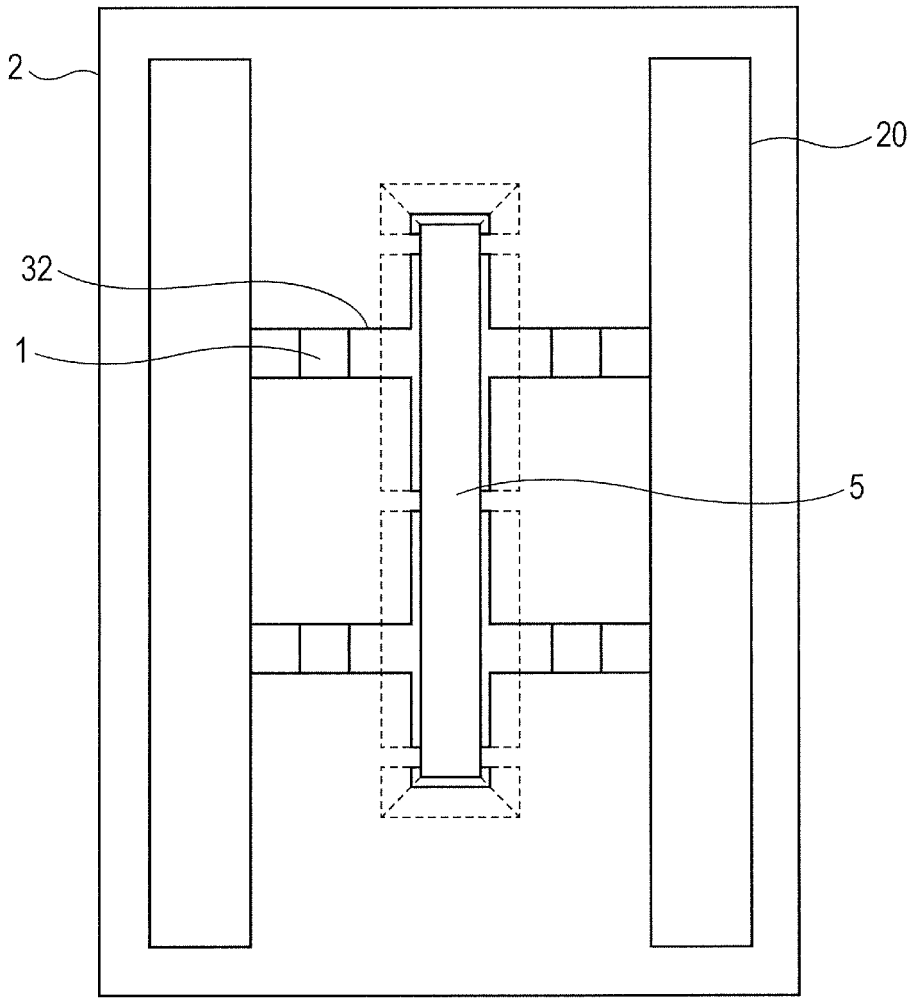
FIG. 9 is a schematic top plan view of a substrate, illustrating an exemplar wiring arrangement of an embodiment of inkjet head body according to the present invention (common supply port type).

The embodiment illustrated in FIGS. 8 and 9 has a common ink supply port type arrangement and a drive circuit 20 is formed on the front surface side of the substrate of the embodiment. The opening of the common ink supply port is rectangular in shape. The lateral wall of the common ink supply port 5 is typically inclined relative to the surface direction of the substrate.

In the embodiment illustrated in FIG. 8, either one 32 of the power wiring and the grounding wiring of the ejection energy generating element is electrically connected to the rear surface side of the substrate by way of a conductive layer 31 and the other one is connected to the drive circuit 20. The wirings connected to the conductive layer 31 are put together as single common wiring arrangement.

In this embodiment, the wiring connected to the conductive layer 31 is preferably the power wiring. As the power wirings of the ejection energy generating element are put together as single common wiring arrangement, the power wiring can be made to have a large width to reduce the parasitic resistance of the power wiring.

In the embodiment illustrated in FIG. 9, the conductive layer 31 is divided into a plurality of regions and functions as plural wiring arrangement for electrically connecting the front surface side and the rear surface side of the substrate.

In this embodiment, the wiring connected to the conductive layer 31 is preferably the power wiring. In FIG. 9, the conductive layer is divided into a plurality of regions, which preferably form individual wirings that respectively correspond to the plurality of power wirings. In this embodiment, the plural power wirings can be individually connected to the rear surface side of the substrate.

Embodiment 6

Figure 10:
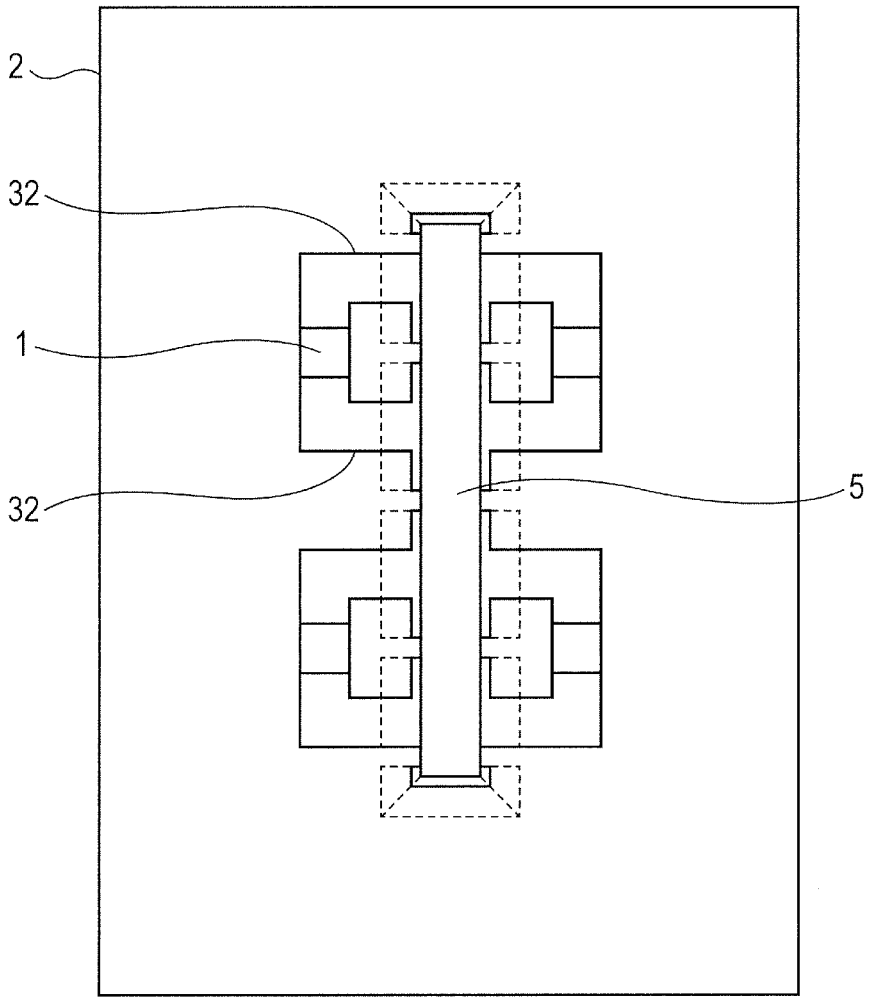
FIG. 10 is a schematic top plan view of a substrate, illustrating an exemplar wiring arrangement of an embodiment of inkjet head body according to the present invention (common supply port type).

The embodiment illustrated in FIG. 10 has a common ink supply port type arrangement and the power wiring and the grounding wiring are connected to the rear surface side of the substrate by way of a conductive layer 31. The conductive layer 31 is divided into a plurality of regions, which function as plural wirings for electrically connecting the front surface side and the rear surface side of the substrate.

Figure 14A:
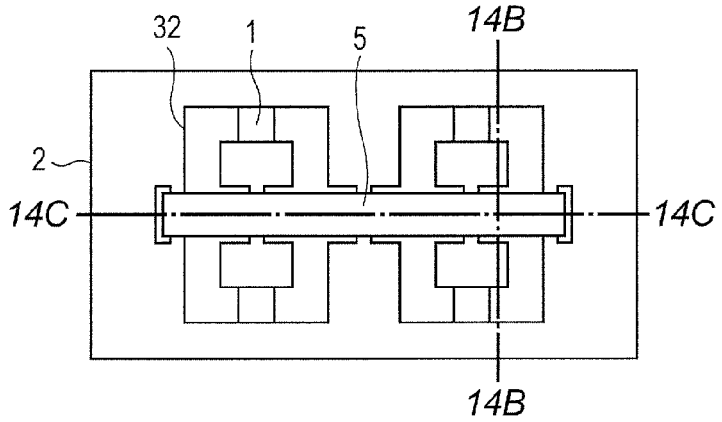
FIGS. 14A, 14B, 14C, and 14D are schematic views of an embodiment of inkjet head body according to the present invention that corresponds to the embodiment of FIG. 10, illustrating a configuration thereof (common supply port type).
Figure 14B:
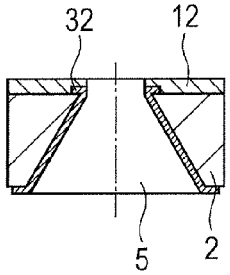
Figure 14C:
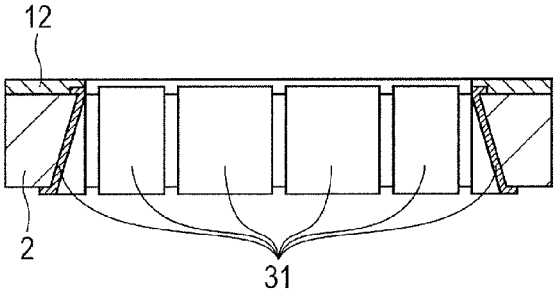
Figure 14D:
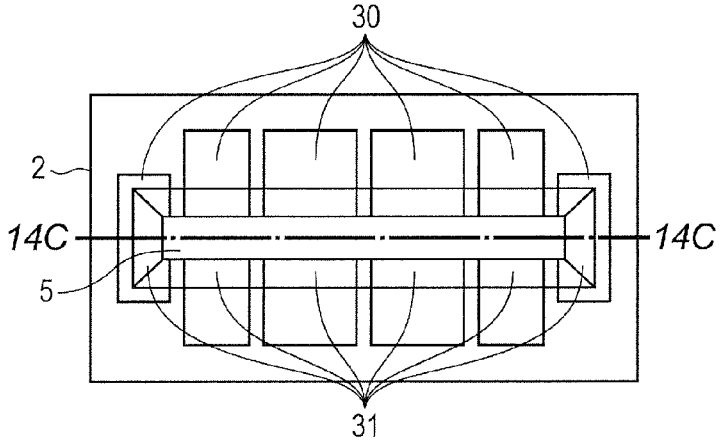

This embodiment will be described in greater detail by referring to FIGS. 14A through 14D. FIGS. 14A through 14D are orthographic views of the segment of the inkjet head body of this embodiment, illustrating the configuration of the substrate thereof. FIGS. 14A and 14D are schematic plan views of the front surface and the rear surface of the substrate. FIG. 14B is a schematic partial cross-sectional view taken along line 14B-14B in FIG. 14A and FIG. 14C is a schematic cross-sectional view taken along line 14C-14C in FIG. 14A (and FIG. 14D).

Embodiment 7

Figure 11:
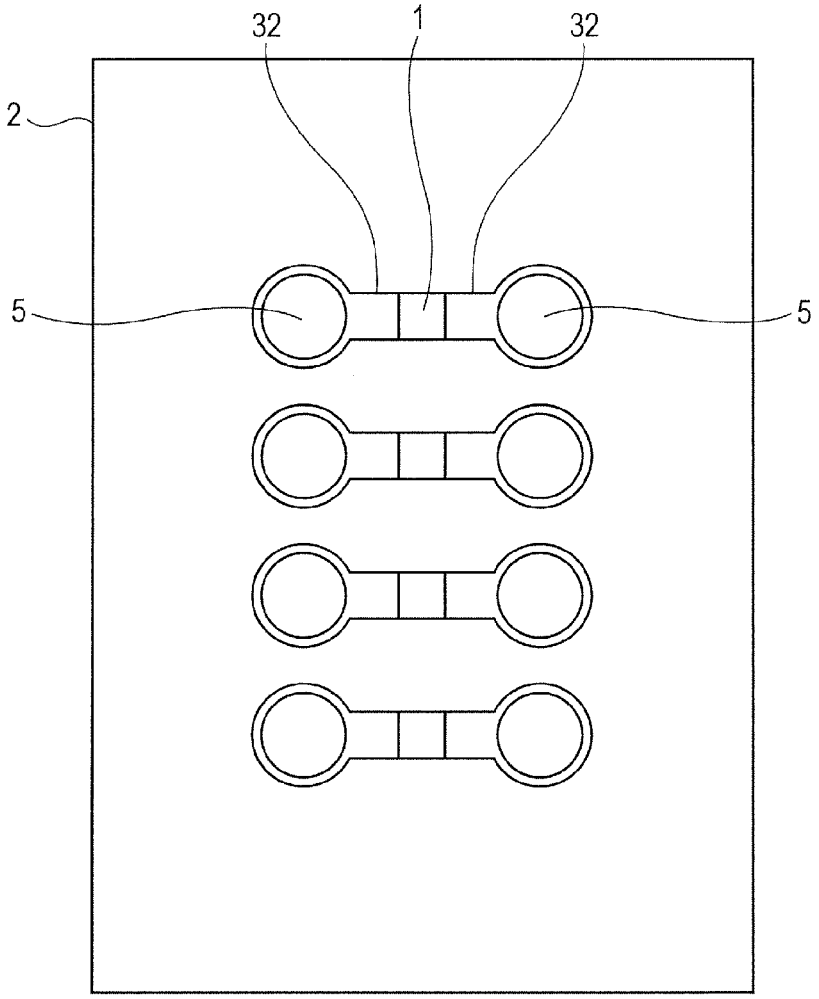
FIG. 11 is a schematic top plan view of a substrate, illustrating an exemplar wiring arrangement of an embodiment of inkjet head body according to the present invention (individual supply port type).

FIG. 11 is a schematic top plan view of a substrate, illustrating an exemplar arrangement of an embodiment of inkjet head body according to the present invention. The embodiment of FIG. 11 has an individual ink supply port type arrangement and no drive circuit is formed on the front surface of the substrate thereof. The power wiring and the grounding wiring 32 of each of the ejection energy generating elements are electrically connected to the rear surface side of the substrate by way of a conductive layer 31 arranged on the lateral surface of an ink supply port 5. In short, electric power is supplied to the power wiring from the rear surface side of the substrate by way of the conductive layer 31. The grounding wiring is grounded at the rear surface side of the substrate by way of the conductive layer 31.

In this embodiment, individual ink supply ports 5 are arranged in two rows at the opposite sides of the ejection energy generating elements that are arranged in a row. Two ink supply ports 5 are provided for a single ejection energy generating element.

This embodiment does not require any row of through-electrodes at the outside of ink supply ports 5 arranged in two rows, for example. Additionally, the power wiring and the grounding wiring of each of the ejection energy generating elements that are linearly connected are not required to make a detour so as to be connected to the through-electrode. Thus, this arrangement is effective for reducing the parasitic resistance of the power wiring and the grounding wiring.

Example 1

An instance of manufacturing an inkjet head body by means of the method illustrated in FIGS. 12A through 12I will be described for this example.

Firstly, as illustrated in FIG. 12A, a 200 μm-thick silicon substrate was brought in as substrate 2. A heater that operates as ejection energy generating element 1 was formed on the silicon substrate. A 0.5 μm-thick metal thin film, or aluminum thin film, was formed and a heater electrode (wiring) was formed out of the aluminum thin film as front surface wiring layer 32. Then, a 0.5 μm-thick silicon oxide film that was to operate as substrate protective film 12 (the uppermost protective film of multi-wiring layers) was formed at the front surface side of the silicon substrate by means of plasma CVD.

Then, as illustrated in FIG. 12B, an ink channel pattern 24 that was to operate as mold member was formed. More specifically, the ink channel pattern 24 was formed firstly by spin coating polymethylisopropylketone (ODUR-1010: tradename, available from TOKYO OHKA KOGYO CO., LTD), which is a dissolvable resin material, and then by patterning the resin material by way of exposure and development steps.

Thereafter, as illustrated in FIGS. 12C and 12D, a channel forming member 3 was formed by spin coating cationic polymerization type epoxy resin and then an ink ejection port 4 was formed by way of exposure and development steps.

Then, as illustrated in FIG. 12E, the silicon substrate was etched from the rear surface side to form a through-hole 5*a*. A mixture gas of $SF_6$ and $C_4F_6$ was employed as etching gas. The Deep-RIE technique of alternately conducting etching steps and film forming steps was employed as etching technique. The through-hole 5*a* was open both at the front surface and at the rear surface of the silicon substrate and also formed through the substrate protective film 12.

Then, as illustrated in FIG. 12F, a conductive layer 31 was formed by means of gold plating. The conductive layer 31 was electrically connected to the metal thin film of aluminum that was formed on the front surface of the silicon substrate so as to operate as heater electrode (wiring). Additionally, a conductive layer 31 was formed on the lateral wall of the through-hole 5*a* and, at the same time, a rear surface wiring layer 30 was formed on the rear surface of the silicon substrate.

Thereafter, as illustrated in FIG. 12G, a 2 μm-thick protective layer 21 was formed on the conductive layer 31 and also on the rear surface of the silicon substrate by means of poly-paraxylylene resin and organic CVD.

Organic CVD film can achieve high covering power and realize an excellent coverage performance at an ink supply port representing a high aspect ratio (e.g., substrate thickness: 200 μm, pore aperture: □50 μm).

Then, as illustrated in FIG. 12H, the protective film 21 of resin at the bottom surface section of the through-hole was removed to produce an ink supply port. This step was executed by means of a laser. In this example, the protective film at the bottom surface section of the ink supply port 5 was partly removed by means of an excimer laser that is an UV pulse laser (wavelength: 248 nm, pulse width: 30 ns, energy density: 0.6 J/cm2). At this time, the film thickness of the protective layer 21 was 2 μm and the resin film was partly removed by a desired thickness by way of a number of shots of irradiation of laser beam. Also at this time, the part of the protective film 21 at the rear surface side of the silicon substrate that was to be turned into external input/output electrodes was also partly removed.

Subsequently, as illustrated in FIG. 12I, the ink channel pattern 24 was dissolved and removed by means of photoresist remover solution that contained methyl lactate to produce an ink channel 25.

An inkjet head body was prepared by way of the above-described steps.

The method of this example was able to eliminate an etching step exclusively for forming a through-electrode that is indispensable for the prior art. As a result, the number of steps for manufacturing a liquid ejection head body can be reduced.

Additionally, the method of this example can form a rear surface wiring layer 30 on the rear surface of a substrate and a conductive layer 31 simultaneously. Then, the operation of masking the ink supply port or the through-electrode that is indispensable for the prior art can also be eliminated to further reduce the number of steps for manufacturing a liquid ejection head body.

Example 2

FIGS. 13A through 13I are schematic cross-sectional views of an embodiment of inkjet head body according to the present invention, illustrating the method of manufacturing the embodiment. In this example, a through-hole is formed in a substrate by means of anisotropic crystal etching.

The steps of the method of this example are the same as those of Example 1 except the step of forming through-hole 5*a*. Now, the step of forming a through-hole 5*a* will be described below.

Figure 13A:
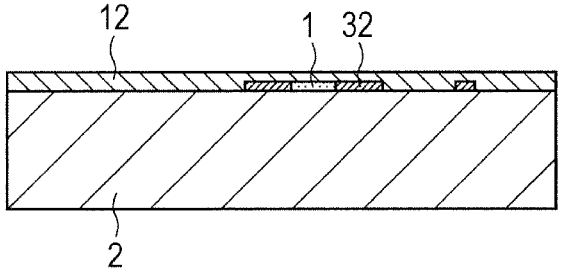
FIGS. 13A, 13B, 13C, 13D, 13E, 13F, 13G, 13H, and 13I are schematic cross-sectional views of an embodiment of inkjet head body according to the present invention, illustrating the method of manufacturing the embodiment (common supply port type).
Figure 13B:
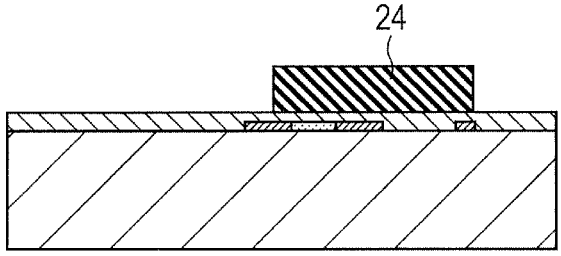
Figure 13C:
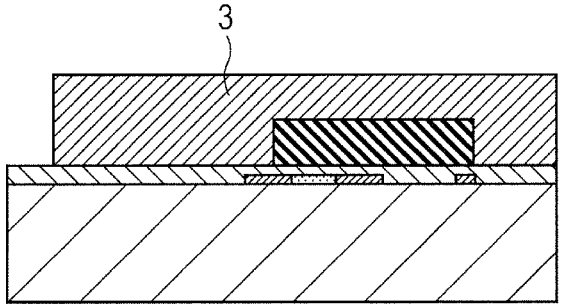
Figure 13D:
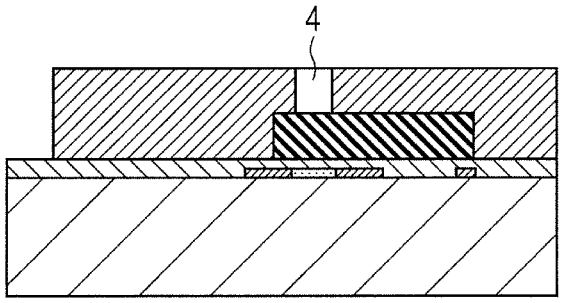
Figure 13E:
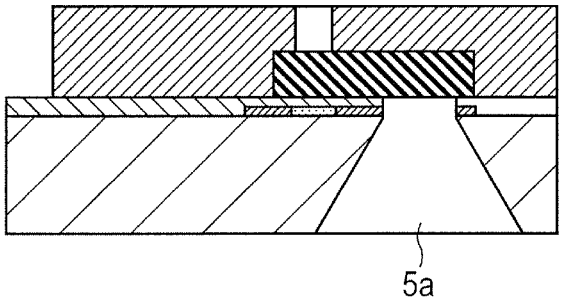
Figure 13F:
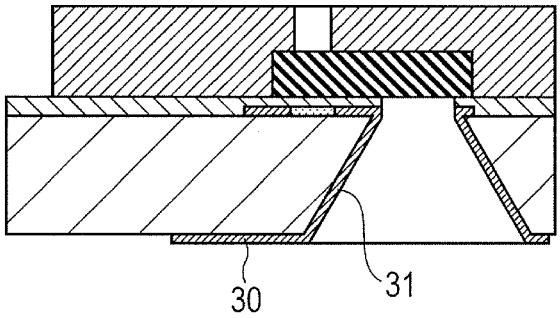

As illustrated in FIG. 13E, the silicon substrate was etched from the rear surface side to produce a through-hole 5*a*. TMAH, that is an alkali solution, and anisotropic crystal etching were employed for the etching operation. The silicon substrate had crystal orientation of wafer surface direction <100> and hence the operation of anisotropic crystal etching proceeded at an angle so that the lateral wall of the through-hole 5*a* was formed with a certain angle of inclination from the rear surface to the front surface of the substrate. Note that the plane direction of the lateral wall of the through-hole 5*a* was <111>.

Example 3

The method of manufacturing an inkjet head body as illustrated in FIG. 14 was employed for this example.

The manufacturing method of this example is the same as the above-described method of Example 2 except that the method of this example has an additional step. Hence, only the added step will be described below and the remaining step will not be described repeatedly.

More specifically, the steps in FIGS. 13A through 13F, or the steps down to the step of forming a conductive layer 31 are the same as those of Example 2.

In this example, a patterning operation was conducted on the conductive layer 31 that was gold plating film formed in the through-hole 5*a* to produce a plurality of wirings as illustrated in FIGS. 14A through 14D. The operation of patterning the conductive layer was conducted from the rear surface of the substrate by way of a laser process.

Figure 13G:
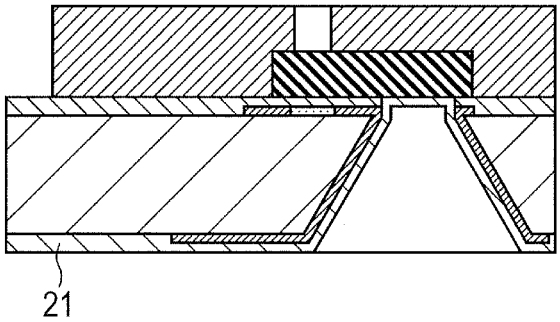
Figure 13H:
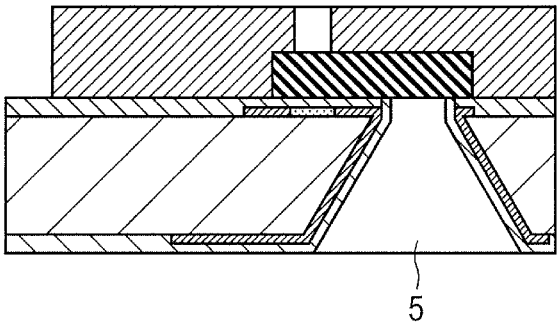
Figure 13I:
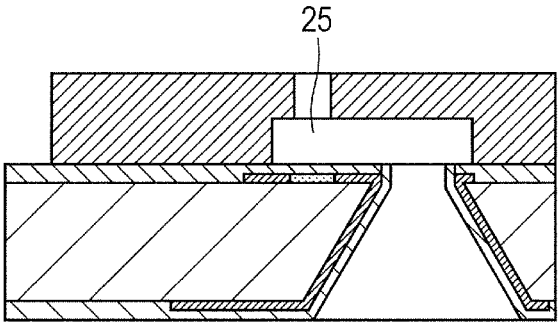

All the following steps are the same as those illustrated in FIGS. 13G through 13I.

With the method of this example, a conductive layer that operates as a wiring arrangement of a plurality of through-electrode wirings can be formed by wiring patterning at a common ink supply port.

Example 4

FIGS. 15A through 15I are schematic cross-sectional views of an embodiment of inkjet head body according to the present invention, illustrating the method of manufacturing the embodiment. Now, an instance of manufacturing an inkjet head body will be described below by referring to FIGS. 15A through 15I.

In this example, a substrate front surface insulating film 13, a substrate rear surface insulating film 22 and a substrate supply port insulating film 33 were arranged respectively between the substrate 2 and the front surface wiring layer 32 that may typically be a heater electrode for the substrate front surface, between the substrate 2 and the rear surface wiring layer 30 and between the substrate 2 and the conductive layer 31. In short, an insulating film was formed between the wiring and the substrate.

Figure 15A:
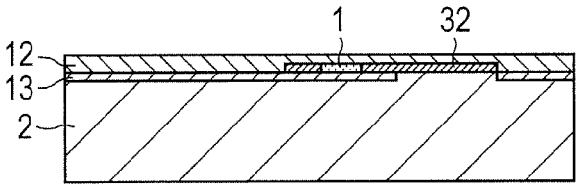
FIGS. 15A, 15B, 15C, 15D, 15E, 15F, 15G, 15H, 15I, 15J, 15K, and 15L are schematic cross-sectional views of an embodiment of inkjet head body according to the present invention, illustrating the method of manufacturing the embodiment (individual supply port type).

Firstly, as illustrated in FIG. 15A, a 200 μm-thick silicon substrate was brought in as substrate 2. Then, a 0.5 μm-thick silicon oxide film that was to operate as substrate front surface insulating film 13 was formed by means of low pressure CVD. For this operation, the part where an ink supply port 5 was to be formed in a later step was subjected to a masking operation in advance so that no silicon oxide film might be formed there. Then, a heater that was to operate as ejection energy generating element 1 was formed on the substrate front surface insulating film 13. Additionally, a heater electrode (wiring) was formed as front surface wiring layer 32 by forming a 0.5 μm-thick metal thin film of aluminum. Then, a 0.5 μm-thick silicon oxide film that was to become substrate protective film 12 (the uppermost protective film of multi-wiring layers) was formed at the front surface side of the silicon substrate by means of plasma CVD.

Figure 15B:
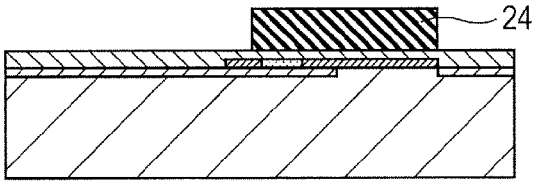

Subsequently, an ink channel pattern 24 was formed as illustrated in FIG. 15B. The ink channel pattern 24 was formed firstly by spin coating polymethylisopropylketone (ODUR-1010: tradename, available from TOKYO OHKA KOGYO CO., LTD), which is a dissolvable resin material, and then by patterning the resin material by way of exposure and development steps.

Figure 15C:
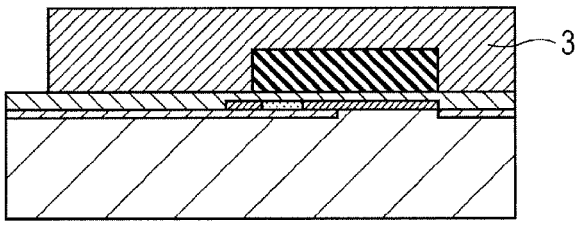
Figure 15D:
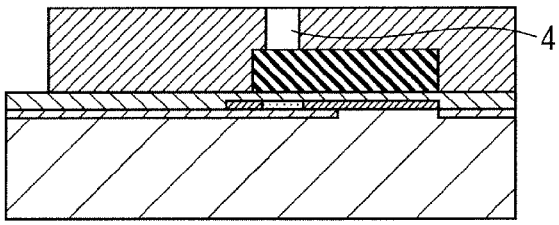

Thereafter, as illustrated in FIGS. 15C and 15D, a channel forming member 3 was formed by spin coating cationic polymerization type epoxy resin and then ink ejection port 4 was formed by way of exposure and development steps.

Figure 15E:
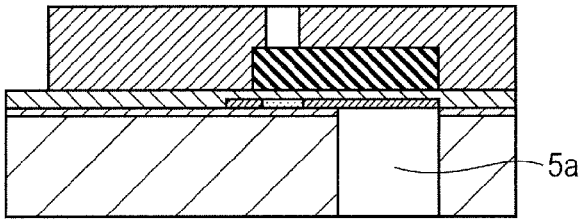

Then, as illustrated in FIG. 15E, the silicon substrate was etched from the rear surface side to form a through-hole 5*a*. A mixture gas of $SF_6$ and $C_4F_6$ was employed as etching gas. The Deep-RIE technique of alternately conducting etching steps and film forming steps was employed as etching technique. The etching operation was stopped at the heater electrode (wiring) 32. The through-hole 5*a* was running through the silicon substrate.

Figure 15F:
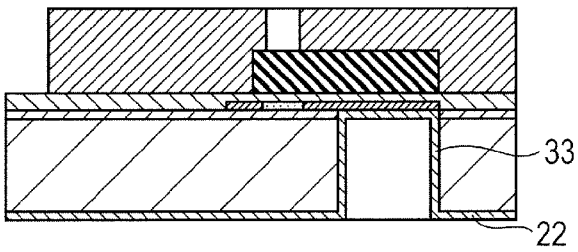

Subsequently, as illustrated in FIG. 15F, a 2 μm-thick poly-paraxylylene resin film was arranged in the through-hole 5*a* and on the rear surface of the silicon substrate by means of organic CVD to form a substrate rear surface insulating film 22 and a substrate supply port insulating film 33.

Figure 15G:
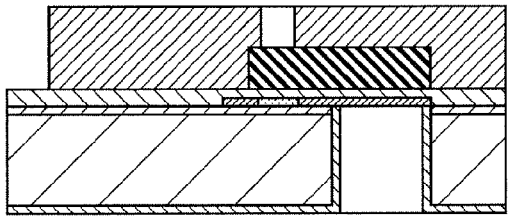

Then, as illustrated in FIG. 15G, the substrate rear surface insulating film 22 at the bottom surface section of the through-hole 5*a* was partly removed. This step was executed by means of laser hole drilling. In this example, a through-hole of about □50 μm was formed by means of an excimer laser that is an UV pulse laser (wavelength: 248 nm, pulse width: 30 ns, energy density: 0.6 J/cm2).

Figure 15H:
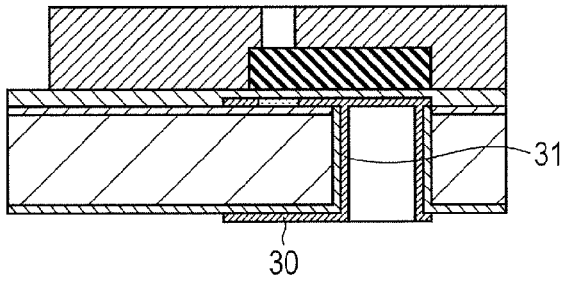

Thereafter, as illustrated in FIG. 15H, a conductive layer 31 was formed by means of gold plating. Additionally, a conductive material was also arranged at the rear surface side of the silicon substrate to form a rear surface wiring layer 30. The conductive layer 31 was electrically connected to the metal thin film of aluminum that was formed on the front surface of the silicon substrate so as to operate as heater electrode (wiring) 32.

Figure 15I:
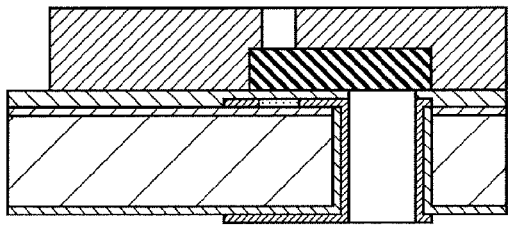

Then, as illustrated in FIG. 15I, the heater electrode (wiring) 32 and the conductive layer 31 at the bottom surface section of the through-hole 5*a* were partly removed by means of a laser. In the laser hole drilling operation, not only the metal film but also the substrate protective film 12 at the bottom surface section of the through-hole 5*a* were removed.

Figure 15J:
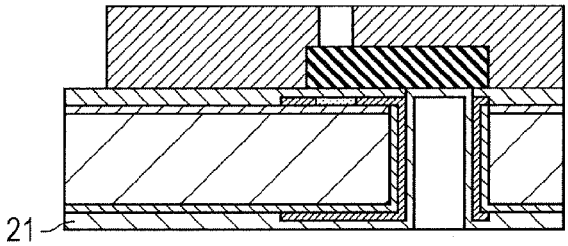
Figure 15K:
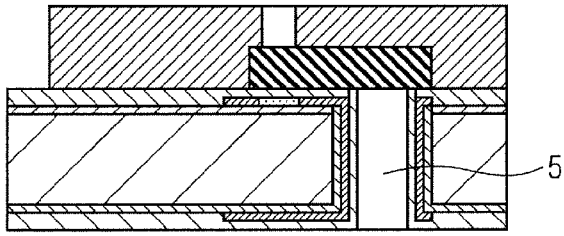

Subsequently, as illustrated in FIGS. 15J and 15K, a 2 μm-thick polyparaxylylene resin film was formed on the conductive layer 31 and also on the rear surface side of the silicon substrate to produce a protective film 21 by means of organic CVD. Then, the protective film 21 at the bottom surface section of the through-hole was partly removed by means of a laser to produce an ink supply port.

The technique employed to form and partly remove the substrate rear surface insulating film 22 and the substrate supply port insulating film 33 could also be employed to form and partly remove the protective film 21.

Figure 15L:
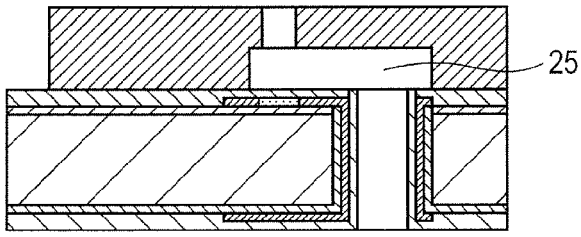

Then, as illustrated in FIG. 15L, the ink channel pattern 24 was dissolved and removed by means of photoresist remover solution that contained methyl lactate to produce an ink channel 25.

An inkjet head body was prepared by way of the above-described steps.

The embodiment described in this example was provided with substrate front surface insulating film 13, substrate rear surface insulating film 22 and substrate supply port insulating film 33. Additionally, an excellent coverage effect can be realized by forming the substrate rear surface insulating film 22 and the substrate supply port insulating film 33 by means of the same material as the protective film 21 for producing organic CVD film. Thus, conductive layer 31 of the inkjet head body of this embodiment is covered by protective film that provides an excellent coverage effect to obtain an excellent ink-resistant property.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-197143, filed Sep. 9, 2011, which is hereby incorporated by reference herein in its entirety.

The invention claimed is:

1. A liquid ejection head body comprising:

a substrate; and a channel forming member arranged on the substrate, the channel forming member having a liquid ejection port for ejecting liquid and a liquid channel communicating with the liquid ejection port, and the substrate having an ejection energy generating element for generating energy for ejecting liquid on a first surface side thereof where the channel forming member is arranged and a liquid supply port running through the substrate from a second surface side opposite to the first surface side to the first surface side to supply the liquid to the liquid channel, wherein a conductive layer for electrically connecting the first surface side and the second surface side is arranged along a lateral surface of the liquid supply port.

2. The liquid ejection head body according to claim 1, wherein the surface of the conductive layer is covered by a protective film that prevents the conductive layer and the liquid from contacting each other.

3. The liquid ejection head body according to claim 1, wherein the ejection energy generating element is electrically connected to the second surface side of the substrate by way of the conductive layer.

4. The liquid ejection head body according to claim 3, wherein the liquid supply port is comprised of a plurality of individual liquid supply ports.

5. The liquid ejection head body according to claim 4, wherein:

a drive circuit is formed at the first surface side of the substrate; and one of a pair of electrodes of the ejection energy generating element is connected to the drive circuit while the other is connected to the conductive layer.

6. The liquid ejection head body according to claim 4, wherein both of a pair of electrodes of the ejection energy generating element are connected to the conductive layer arranged in the individual liquid supply ports.

7. The liquid ejection head body according to claim 6, wherein:

two individual liquid supply ports communicate with the ejection energy generating element;

one of the pair of electrodes of the ejection energy generating element is connected to the conductive layer arranged at one of the two individual liquid supply ports; and the other of the pair of electrodes is connected to the conductive layer arranged at the other one of the two individual liquid supply ports.

8. The liquid ejection head body according to claim 3, wherein the liquid supply port is comprised of a common liquid supply port.

9. The liquid ejection head body according to claim 8, wherein:

a drive circuit is formed at the first surface side of the substrate; and one of the pair of electrodes for driving the ejection energy generating element is connected to the drive circuit while the other wiring is connected to the conductive layer.

10. The liquid ejection head body according to claim 8, wherein the conductive layer is comprised of a plurality of separate wires each electrically connecting the first surface side and the second surface side.

11. The liquid ejection head body according to claim 10, wherein the ejection energy generating element is comprised of a plurality of individual generating elements connected to the separate wires.

12. The liquid ejection head body according to claim 8, wherein:

the conductive layer is comprised of a plurality of separate wires each electrically connecting the first surface side and the second surface side; and both of the pair of electrodes of the ejection energy generating element are connected to each of the plurality of wires constituting the conductive layer.

13. The liquid ejection head body according to claim 1, wherein an insulating film is arranged between the substrate and the conductive layer.

14. The liquid ejection head body according to claim 1, wherein the liquid ejection head body is an inkjet head body for ejecting ink as the liquid.

15. A method of manufacturing a liquid ejection head body comprising:

(1) a step of providing a substrate having an ejection energy generating element for generating energy for ejecting liquid and a surface wiring layer for driving the ejection energy generating element at a first surface side thereof;

(2) a step of etching the substrate from a second surface side disposed opposite to the first surface side to form a through-hole for liquid supply;

(3) a step of forming a conductive layer to be connected to the surface wiring layer on a lateral surface of the through-hole; and (4) a step of forming a protective film on the conductive layer.

16. The method according to claim 15, wherein the substrate is a silicon substrate and the through-hole is formed by means of anisotropic crystal etching of the silicon substrate in the step (2).

17. The method according to claim 16, wherein a lateral wall representing a certain inclination is formed by the anisotropic crystal etching.

18. The method according to claim 17, further comprising:

a step of patterning the conductive layer to produce a plurality of wirings connecting the first surface side and the second surface side between the step (3) and the step (4).

19. The method according to claim 15, further comprising a step of forming an insulating film on the lateral surface of the through-hole between the step (2) and the step (3), so as to form the conductive layer on the insulating film in Step (3).

20. The method according to claim 19, wherein the insulating film and the protective film are formed by the same resin material and organic CVD.

* * * * *